US009265692B2

(12) United States Patent
Aelen et al.

(10) Patent No.: US 9,265,692 B2
(45) Date of Patent: Feb. 23, 2016

(54) CHEST PAD FOR AUTOMATED CPR DEVICE

(75) Inventors: Paul Aelen, Eindhoven (NL); Igor Wilhelmus Franciscus Paulussen, Eindhoven (NL); Pierre Hermanus Woerlee, Eindhoven (NL); Gerrit Jan Noordergraaf, Diessen (NL)

(73) Assignee: Koninklijke Philips N.V., Eindhoven (NL)

( * ) Notice: Subject to any disclaimer, the term of this patent is extended or adjusted under 35 U.S.C. 154(b) by 697 days.

(21) Appl. No.: 13/515,543

(22) PCT Filed: Dec. 13, 2010

(86) PCT No.: PCT/IB2010/055767

§ 371 (c)(1),
(2), (4) Date: Jun. 13, 2012

(87) PCT Pub. No.: WO2011/073878

PCT Pub. Date: Jun. 23, 2011

(65) Prior Publication Data

US 2012/0245495 A1 Sep. 27, 2012

(30) Foreign Application Priority Data

Dec. 18, 2009 (EP) ..... 09179951

(51) Int. Cl.
*A61H 31/00* (2006.01)
*A61H 31/02* (2006.01)

(52) U.S. Cl.
CPC ..... *A61H 31/004* (2013.01)

(58) Field of Classification Search
CPC ... A61H 31/00; A61H 31/004; A61H 31/005; A61H 31/006; A61H 31/007; A61H 31/008; A61H 31/02
USPC ..... 601/41–44
See application file for complete search history.

(56) References Cited

U.S. PATENT DOCUMENTS

| | | | | |
|---|---|---|---|---|
| 3,503,388 | A * | 3/1970 | Cook | 601/41 |
| 4,095,590 | A | 6/1978 | Harrigan | |
| 4,570,615 | A | 2/1986 | Barkalow | |
| 5,630,789 | A * | 5/1997 | Schock et al. | 601/41 |
| 6,066,106 | A | 5/2000 | Sherman et al. | |
| 6,171,267 | B1 | 1/2001 | Baldwin | |
| 6,332,872 | B1 | 12/2001 | Young | |
| 6,645,163 | B2 | 11/2003 | Kelly et al. | |
| 7,361,151 | B2 * | 4/2008 | Wood | 601/41 |
| 2001/0011159 | A1 | 8/2001 | Cantrell et al. | |
| 2004/0230140 | A1 | 11/2004 | Steen | |
| 2008/0119766 | A1 | 5/2008 | Harvardsholm et al. | |
| 2009/0093741 | A1 * | 4/2009 | Lach | 601/41 |

FOREIGN PATENT DOCUMENTS

| | | | |
|---|---|---|---|
| JP | H07178144 | A | 7/1995 |
| JP | 2000501971 | A | 2/2000 |
| WO | 9610984 | A1 | 4/1996 |

* cited by examiner

*Primary Examiner* — Justine Yu
*Assistant Examiner* — Kathrynn Lyddane

(57) ABSTRACT

A pad device for the transfer of force to an anterior chest wall during cardiopulmonary resuscitation (CPR) includes at least two pad elements adapted to be positioned on an anterior chest wall surface, a hinge mechanism connecting the at least two pad elements, the at least two pad elements being movably mounted to the hinge mechanism, such that the hinge mechanism cooperatively responds to a force applied when the patient is receiving a CPR.

16 Claims, 3 Drawing Sheets

CHEST PAD FOR AUTOMATED CPR DEVICE

FIELD OF THE INVENTION

The field of the present invention relates to a pad device for the transfer of force to the anterior chest wall during cardiopulmonary resuscitation (CPR), and an apparatus for CPR equipped with such a pad device.

DESCRIPTION OF THE RELATED ART

Sudden Cardiac Arrest (SCA) is one of the main causes of death in the western world. The resulting whole body ischemia after the SCA disturbs a wide range of cell processes, leading to severe cell damage and death unless acute medical care is available. It has been reported that the probability for survival after sudden cardiac arrest decreases linearly with 7-10% per minute of arrest time.

Cardio Pulmonary Resuscitation (CPR) can be performed whenever a patient suffers a sudden cardiac arrest. The procedure consists of, but is not limited to performing regular and rhythmic chest compressions to the sternum of the patient, at a rate of circa 100 compressions per minute. Successful CPR requires that pressure is applied to the chest and it may be very difficult to administer consistent, high-quality manual chest compressions, with suitable pressures. Since CPR is key for survival, mechanical automated devices (A-CPR) have been developed to replace less reliable, frequently interrupted, difficult to control, and sometimes lengthy in duration manual CPR. Anterior wall trauma, caused by CPR, may be an unique, negative, cofactor in survival after resuscitation.

Different automated CPR apparatus have been introduced in the market. A first type of CPR apparatus uses techniques such as pneumatics to drive a compressing rod with cup on to the chest of the patient. Another type of automated CPR is electrically powered and uses a large band around the patient's chest which contracts in rhythm in order to deliver chest compressions. The compression frequency is fixed and is controlled accurately such that high quality chest compressions can be achieved.

The patent publication US 20040230140A1 describes a type of A-CPR where a compressing pad is driven onto the chest of the patient. The pad is small and round-shaped, and focuses the force on a small area. The pad does not adapt its angle or form factor so that on thoraces that make an angle with the horizontal, the force is focused even more by pressing only on a part of the pad. Because of this thorax angle, the force has a radial and tangential component and the pad will shear along the thorax. Additionally, migration of the pad during use may occur as well.

Manual, as well as automated systems often induce trauma, such as rib- or sternal fractures, skin lesions and all sorts of internal trauma. Important issues in the CPR devices include long set-up times, low stability during operation of the device, as well as suggestions and clinical evidence that insufficient force is being applied for optimal performance. Even with the relatively "low" forces used in known automated CPR devices, serious and fatal injuries have been reported. Poor contact between pad and anterior chest wall as well as shifts of the CPR pad due to poor stability and high local pressures at the chest surface have been related to a higher incidence of anterior and lateral chest wall trauma.

Also for manual CPR, a number of these issues have been reported. Even for trained people it is difficult to correctly position the hands on the anterior wall chest to efficiently transmit the force. Both the low force and CPR related trauma affect the outcome the resuscitation significantly.

BRIEF SUMMARY OF THE INVENTION

It would be desirable to develop a pad device that optimizes the transfer of compressive force during chest compressions and a CPR device equipped with such a pad device.

It would also be desirable to develop a pad device that minimizes the trauma induced on the patient. Moreover, it would be desirable to have a device with a pad element that closely follows the contour of the patient body, during all operating phases of CPR.

In order to address at least one of these concerns and/or other concerns, a pad device for the transfer of force to an anterior chest wall during cardiopulmonary resuscitation according to the invention, comprises at least two pad elements adapted to be positioned on an anterior chest wall surface, a hinge mechanism connecting the at least two pad elements, the at least two pad elements being movably mounted to the hinge mechanism, such that the hinge mechanism cooperatively responds to a force applied when the patient is receiving chest compressions.

By providing a pad device with a hinge mechanism connecting the pad elements, an optimal transfer of force can be achieved. The cooperative response of the hinge mechanism to the applied force, or in other words to the counter force of the anterior chest wall when compressive force is applied, allows the pad elements to closely follow the contour of the anterior chest wall during all stages of CPR. The hinge mechanism therefore ensures that the chest wall is continuously being followed incorporating the changes in thoracic wall shape during the course of resuscitation.

Contrary to the prior art systems where poor contact between pad and anterior chest wall led to poor stability and high local pressures at the chest surface, the pad device of the present invention allows the pad elements to closely follow the contour of the anterior chest wall during all stages of the CPR, thereby reducing the force per area unit. A greater amount of force may be applied, without a concomitant increase in trauma. This is critical to the outcome of the resuscitation which may improve significantly.

In one aspect of the invention, the at least two pad elements are pivotally mounted to the hinge mechanism. A pivotal motion of the pad elements to the hinge mechanism is preferred. During the administration of compressions dynamic changes in thorax shape and in chest wall configuration may occur. By allowing pivoting of the pad elements with respect to the hinge mechanism, the pad elements are adapted to follow the changes of surface of the anterior chest wall.

In another aspect of the invention one of the at least two pads elements is pivotally connected to a first member of the hinge mechanism and another of the at least two pads elements is pivotally connected to a second member of the hinge mechanism. Having the two pad elements connected to two members of the hinge mechanism allows for the independent pivoting of the pad elements, thereby covering the movement of the chest wall at both sides of the sternum when the pad device is in use on the patient's chest.

In a further aspect of the invention, the at least two pads elements are pivotally connected to the hinge mechanism around two respective first pivots being parallel to each other.

In a preferred aspect, the pad device comprises a connecting part to connect the pad device to a force application member of a CPR apparatus or to a CPR aid. The pad device can be used for performing CPR using an automated CPR apparatus having an automated force application member.

The pad device may also be used by a person performing the chest compressions manually as part of CPR. By using such a pad, the transmission of force is facilitated at all times of resuscitation, providing a improved pressure distribution compared to manual CPR.

In another aspect of the invention, the at least two pads elements are pivotally mounted to the connecting part around a second pivot of the pad device. Preferably the at least two pads elements are pivotally mounted to the connecting part around a third pivot of the pad device. The connecting part acts as a double hinge mechanism allowing the pad elements to pivot in bloc, adding an additional degree of freedom to the pad device.

By choosing the first pivot mainly parallel to a longitudinal direction of the patient's chest, the pad elements may pivot or flip/flap in a up and down direction, responsive to the chest anatomic variation (i.e. sternum-to-ribs). By choosing the second pivot mainly parallel to a transversal direction of the patient's chest (also referred to as a central-lateral direction) and the third pivot mainly parallel to a longitudinal direction of the patient's chest (also referred to as a caudal-cranial direction), full movement of the chest surface can be closely followed, when the pad device is in an operative position on the patient's chest.

In other words, the at least two pad elements are each pivotally connected to the hinge mechanism for a flip flap in a up and down direction during resuscitation, whereby the force applied during compression can be distributed following a given force distribution. The at least two pad elements are also preferably both pivotally connected to common second and third pivot allowing rotation in caudal-cranial and central lateral directions allowing for full chest movement follow up.

Of course, it is possible to add more freedom of movement with more pivotal couplings.

In a preferred aspect of the invention, the pad device comprises a central pad element and two lateral pad elements, wherein the two lateral pad elements are pivotally mounted to the hinge mechanism, the central pad element linking the two lateral pad elements together. A central pad element advantageously provides explicit support for the sternum whilst the two lateral elements may provide support for the ribs at both sides.

Although the present invention has been described with two lateral pad elements, more lateral pad elements could be provided.

In a further aspect of the invention, the central pad element has a pair of elongated or oval slots, each slot being connected by a pin means to respective holes in the two lateral pad elements. Oval slots allows for pivotal movement of the lateral pad elements about the first and second pivots at the first and second members of the hinge mechanism.

Additionally the force distribution can be better chosen with three pad elements than with two pad elements.

It would further be desirable to reduce shear force between the compression pad and the thoracic wall surface. To address this concern, the at least two pad elements comprise antifriction means on a surface designed to contact the patient's chest surface. This is particularly helpful when the force is not applied orthogonally with respect to the patient chest surface. In a preferred embodiment, a contact part is designed to be in direct contact with the patient's chest surface. A visco-elastic material is interposed between the surface of the at least two pad elements, designed to maximize contact between the patient's chest surface and the at least two pad elements, and minimize the focusing of pressure.

In a preferred embodiment, the at least two pad elements are dimensioned to cover at least the origo of 3 ribs and to cover both the sternum and the adjacent sterno-costal junction/costae. The transfer of force thereby is achieved on a large surface, supporting the sterno-costal junctions, yet without focus points and high force density.

It would be desirable that the pad is adaptable to different thorax and chest shapes. This and other concerns are addressed by providing a pad device wherein the at least two pad elements are curved to adapt to a body, in particular the at least two pad elements comprising at least one of a lateral curvature to allow adaptation to a female breast and a caudal curvature to avoid force application on the xyphoid process. Additionally, rounded edges may be provided to avoid focusing of force on critical organs such as liver and spleen.

By providing a pad device being symmetrical in a cranial caudal direction, the pad device can be applied in two directions so that it cannot be placed wrongly and therefore is faster to use.

Finally a CPR apparatus equipped with a pad device according to the invention is also contemplated.

These and other aspects of the invention will be apparent from and illustrated with reference to the embodiment(s) described herein after.

DETAILED DESCRIPTION OF THE EMBODIMENTS

The invention will now be described on the basis of the drawings. It will be understood that the embodiments and aspects of the invention described herein are only examples and do not limit the protective scope of the claims in any way. The invention is defined by the claims and their equivalents. It will also be understood that features of one aspect can be combined with a feature of a different aspect or aspects.

For a complete understanding of what is taught and the advantages thereof, reference is now made to the following detailed description taken in conjunction with the Figures.

Figure 1:
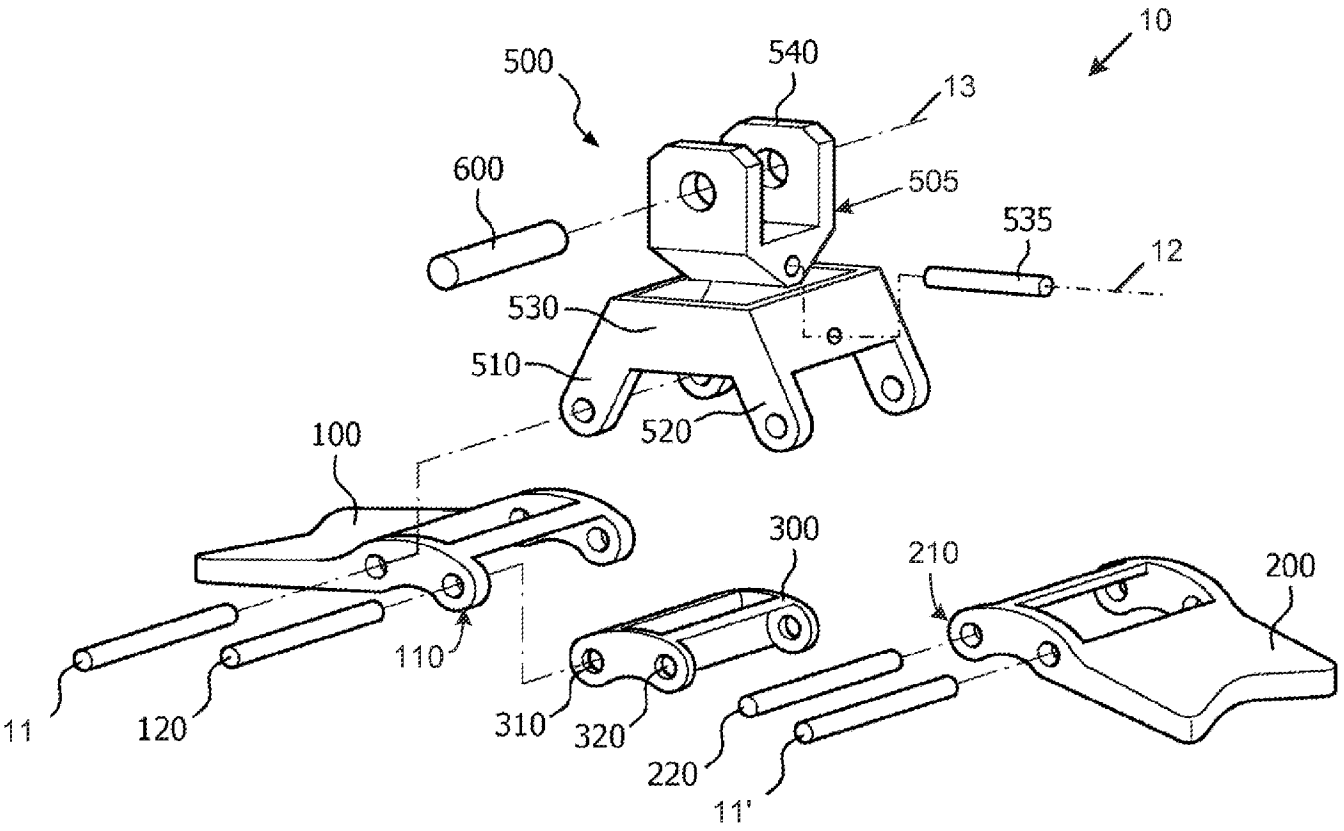
FIG. 1 shows an exploded schematic view of a pad device according to the invention.

FIG. 1 shows an exploded schematic view of a pad device 10 according to the invention. The pad device 10 comprises three pad elements 100, 200, 300, with a first lateral pad element 100 (on the left on the Figure), a second lateral pad element 200 (on the right side on the Figure), connected by a central pad element 300.

In the present description, the left and right directions are defined with respect to the Figures. Reference is also made to a patient chest, when the pad device is in operative position on the patient's chest. This is arbitrarily and it does not restrict the scope of the invention.

The two lateral pad elements 100, 200, are pivotally mounted to an upper member 505 of the hinge mechanism 500, the central pad element 300 linking the two lateral pad elements together 100, 200. The first (left) lateral pad element is pivotally connected to a first (left) member 510 of the hinge mechanism 500 by a first (left) pivot pin 11 and the second (right) lateral pad element 200 is pivotally connected to a second (right) member 520 of the hinge mechanism 500 around a second (right) pivot pin 11'. The first (left) pivot pin 11 and the second (right) pivot pin 11' are mainly parallel to each other.

An inner end 110 of the first (left) lateral pad element 100 is connected by a pin 120 to a first (left) hole 310 of the central pad element 300 and an inner end 210 of the second (right) lateral pad element 200 is connected by a pin 220 to a second (right) hole 320 of the central pad element 300. The pins 120, 220 are mainly parallel to first and second pivot pins 11, 11'.

The slots 310, 320 of the central pad element 300 are mainly oval instead of perfectly round. The oval slots allow the pivoting movement of the two lateral pad elements 100, 200 around their respective pivot pins 11, 11'. The central pad element 300 chains the two lateral pad elements 100, 200 together.

First (left) member 510 and second (right) member 520 of the hinge mechanism 500 are linked by a central part 530 of the hinge mechanism 500, thereby straddling the central pad element 300. In the described embodiment, the first and second members and the central part of the hinge mechanism are constructed as a one piece, unitary member, but other configurations are contemplated.

The central part 530 is pivotally linked to an upper part 540 of the hinge mechanism 500 by a pivot pin 535 around a second pivot 12 of the pad device 10. The second pivot 12 is mainly orthogonal to the first pivots 11, 11'.

The upper part 540 of the hinge mechanism is in turn pivotally connected to a connecting part in the form of a pin 600. The pivot pin 600 forms a third pivot 13 of the pad device 10.

The pivot pin 600 may connect the pad device 10 to a force application member 905 of a CPR apparatus 900 (FIG. 5) should the pad device be used in an automated CPR apparatus system.

The pivot pin 600 may otherwise connect the pad device 10 to a gripping member or handle should the pad device be used as part of a first aid kit by a person directly performing CPR. In this case, the person performing the first aid procedure may use the pad device as a tool for improved positioning on the chest surface and force transfer. This is particularly helpful as the person performing the CPR, even well trained and educated to CPR procedure, may have difficulties in correctly positioning the hands and actually waste a lot of energy due to a poor force transfer from the person to the patient's chest.

The pads elements 100, 200, 300 are therefore being pivotally mounted to the connecting part around at least two pivots, allowing the pad elements 100, 200, 300 to pivot in bloc with respect to second and third pivots 12, 13, respectively.

Figure 2:
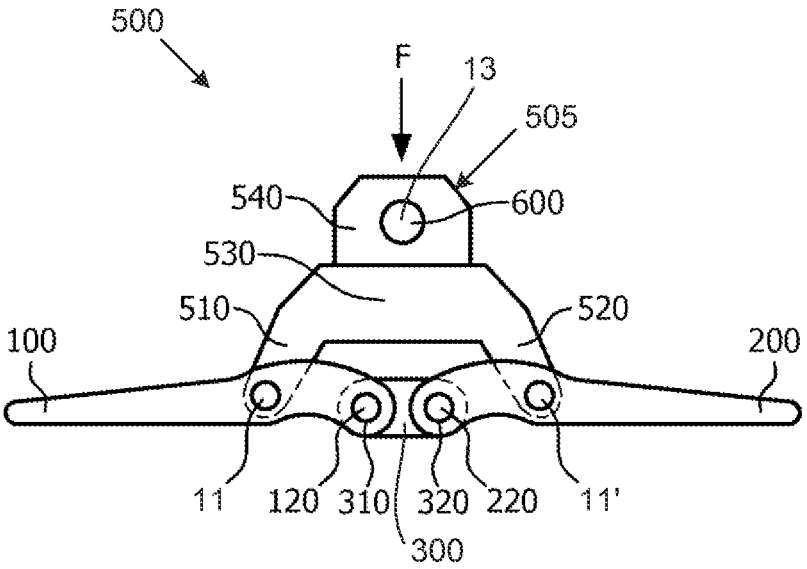
FIG. 2 shows a side view of a pad device according to one aspect of the invention.
Figure 3:
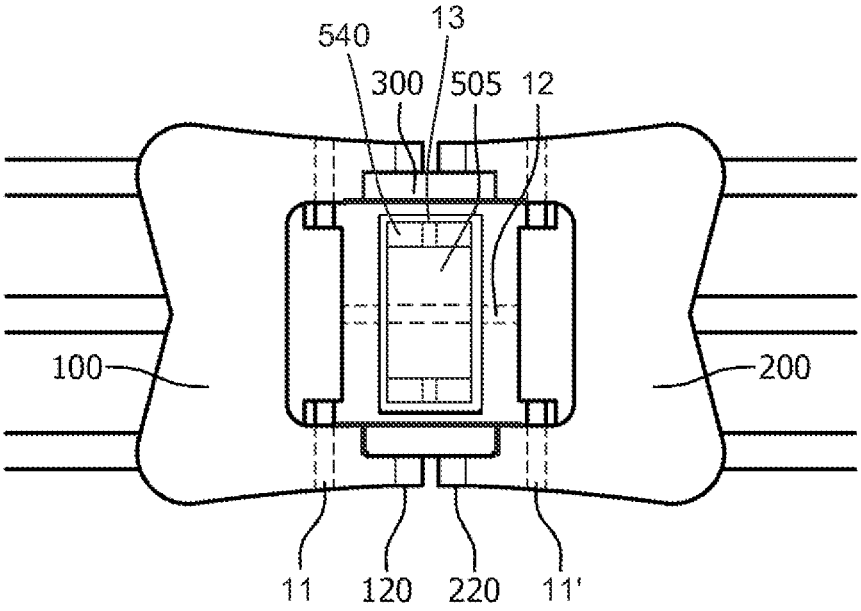
FIG. 3 shows a top view of a pad device according to one aspect of the invention.

From FIGS. 1 to 3, when the pad device 10 is in an operative position on the patient's chest, the first pivot (11, 11') is mainly parallel to a longitudinal direction of the patient's chest, the second pivot being mainly parallel to a transversal direction of the patient's chest and the third pivot being mainly parallel to a longitudinal direction of the patient's chest.

When the pad device 10 is in an operative position on the patient's chest, the first pivot 11, 11' allows the up and down pivoting of the lateral pad elements 100, 200. The two additional pivots 12, 13 are mainly orthogonal one to each other, in a cranial caudal direction and in a central lateral direction.

The main movements of the chest may be closely followed by the pad device. Whilst the present application is described with three pivot coupling, other configurations with more rotational freedom may be contemplated. A full rotation capability may also be obtained by connecting the at least two pad elements to a spherical mounting.

The transfer of force is preferably achieved by the first pivot P1, P1', and different configurations may be chosen for the transfer of the compressive force to the chest via the different pivots P1, P1'. A preferred configuration distributes ⅔ of the compressive force at the central pad element 300, and ⅙ of the compressive force at each of the lateral pad elements 100, 200. Any other force distribution can be contemplated.

As best seen on FIG. 3, the pad elements 100, 200, 300 are further designed for adaptation to various chest shapes. The lateral pad elements 100, 200, have an outer lateral curvature and a caudal curvature to avoid force application on a xyphoid process. The lateral curvatures allow the lateral pad elements to fall around women breasts whilst pushing them aside. Advantageously the pad device is suitable for both male and female anterior chest shapes.

As seen on the top schematic view of FIG. 3, showing the pad device 10 on a schematic torso, the pad device is preferably dimensioned to cover at least 3 ribs and to cover both the sternum and the adjacent sterno-costal junction/costae. Additionally, rounded edges may be provided to avoid focusing of force on critical organs such as liver and spleen such a pad device therefore avoids the focusing of the force on a small area.

Figure 4:
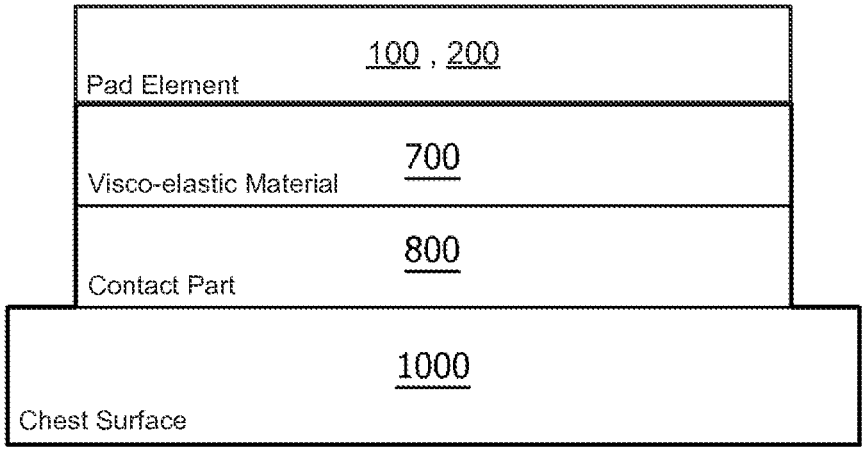
FIG. 4 shows an example of anti-friction arrangement according to the invention.

The pad device comprises antifriction means in a further aspect of the invention, as best seen on FIG. 4. The pad elements 100, 200, 300 have a contact part 800 designed to contact the patient's chest surface 1000. A visco-elastic material 700 is interposed between pad elements and the contact part 800. The layer of visco-elastic material advantageously maximizes the contact area between the pad elements and the thoracic wall surface.

Figure 5:
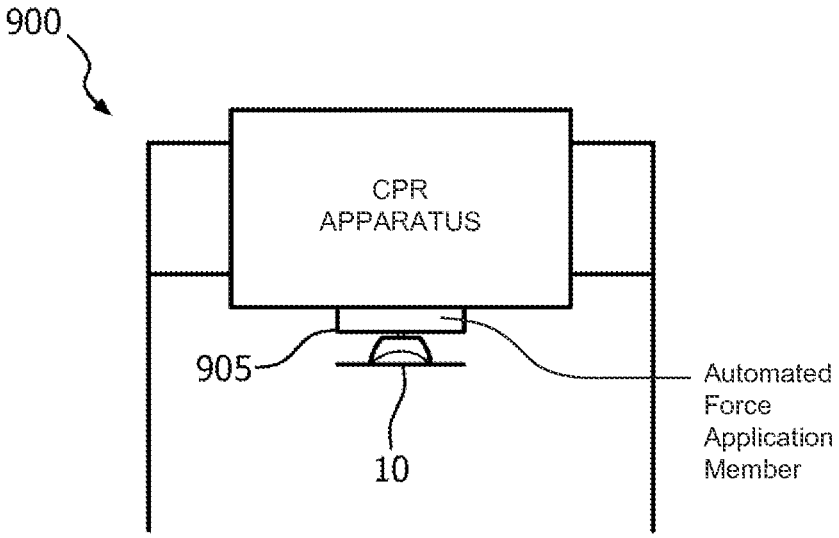
FIG. 5 shows a schematic automated CPR apparatus equipped with a pad device according to the invention.

The pad device 10 may be connected to an automated CPR apparatus, as schematically shown on FIG. 5. The CPR apparatus 900 has an automated force application member 905 which transmits the force to the pad device 10.

It should be appreciated that the various aspects of the disclosed system for the discussed herein are merely illustrative of the specific ways to make and use of the and do not therefore limit the scope of what is disclosed when taken into consideration with the claims and the following detailed description. It will also be appreciated that features from one embodiment of the disclosed system and method may be combined with features from another embodiment of the disclosed method and system.

The described and illustrated device is potentially useful both in-hospital and out-of-hospital.

Other variations to the disclose embodiments can be understood and effected by those skilled in the art in practicing the claimed invention from study of the drawings, the disclosure, and the appended claims. In the claims, the word "comprising" does not exclude other elements or steps, and the indefinite article "a" or "an" does not exclude a plurality. A single unit may perform functions of several items recited in the claims, and vice versa. The mere fact that certain measures are recited in mutually different dependent claims does not indicate that combination of these measures cannot be used to advantage. Any reference signs found in the claims should not be construed as limiting the scope.

LIST OF REFERENCES

Pad device 10
Pad elements 100, 200, 300
First (left) pivot pin 11
Second (right) pivot pin 11'
Second pivot 12
Third pivot 13
Inner end 110
Inner end 210
Pivot pin 120
Pivot pin 220
Hinge mechanism 500
Upper member 505
First (left) member 510
A second (right) member 520
Central part 530
Upper part 540
Connecting pin 600
Visco-elastic material 700
Contact part 800
CPR device 900
Force application member 905
Chest surface 1000

The invention claimed is:

1. A pad device for the transfer of force to an anterior chest wall of a patient during cardiopulmonary resuscitation (CPR), comprising:

at least two pad elements adapted to be positioned on an anterior chest wall surface, wherein the at least two pad elements comprise two lateral pad elements and a central pad element linking the two lateral pad elements together at respective inner ends of the two lateral pad elements; and a hinge mechanism coupled to the two lateral pad elements of the at least two pad elements, the two lateral pad elements being movably mounted to respective first and second members of the hinge mechanism, such that the hinge mechanism cooperatively responds to a force applied when the patient is receiving a CPR; wherein one of the two lateral pad elements is pivotally connected to the first member of the hinge mechanism and another of the two lateral pad elements is pivotally connected to the second member of the hinge mechanism, wherein the two lateral pad elements are pivotally connected to the hinge mechanism around two first respective pivots, being mainly parallel to each other, further comprising a connecting part configured to connect the pad device to a force application member of a CPR apparatus or to a gripping part, wherein the at least two pad elements are pivotally mounted to the connecting part around a second pivot of the pad device.

2. The pad device according to claim 1, wherein the two lateral pad elements of the at least two pad elements are pivotally mounted to the hinge mechanism.

3. The device according to claim 1, wherein the at least two pad elements are further pivotally mounted to the connecting part around a third pivot of the pad device in addition to the second pivot.

4. The pad device according to claim 3, wherein the two first respective pivots are mainly parallel to a longitudinal direction of the patient's chest, the second pivot is mainly parallel to a transversal direction of the patient's chest and the third pivot is mainly parallel to a longitudinal direction of the patient's chest, in response to the pad device being placed in an operative position on the patient's chest.

5. The pad device according to claim 1, wherein the central pad element includes a pair of elongated slots, each elongated slot being connected by a pin to respective holes at the inner ends of the two lateral pad elements.

6. The pad device according to claim 1, wherein the at least two pad elements each comprise an antifriction contact part designed to contact the patient's anterior chest wall surface.

7. The pad device according to claim 6, further wherein a visco-elastic material layer is disposed between each pad element of the at least two pad elements and a respective antifriction contact part.

8. The pad device according to claim 1, wherein the at least two pad elements are dimensioned to cover at least 3 ribs and to cover both a sternum and an adjacent sterno-costal junction/costae.

9. The pad device according to claim 1, wherein the at least two pad elements are curved to adapt to a body, further wherein the at least two pad elements comprise at least one of a lateral curvature to allow adaptation to a female breast and a caudal curvature to avoid force application on a xyphoid process, the pad device further being mainly symmetrical in a cranial caudal direction.

10. A cardiopulmonary resuscitation (CPR) apparatus equipped with a pad device comprising at least two pad elements adapted to be positioned on an anterior chest wall surface, wherein the at least two pad elements comprise two lateral pad elements and a central pad element linking the two lateral pad elements together at respective inner ends of the two lateral pad elements; and a hinge mechanism coupled to the two lateral pad elements of the at least two pad elements, the two lateral pad elements being movably mounted to respective first and second members of the hinge mechanism, such that the hinge mechanism cooperatively responds to a force applied when the patient is receiving a CPR; wherein one of the two lateral pad elements is pivotally connected to the first member of the hinge mechanism and another of the two lateral pad elements is pivotally connected to the second member of the hinge mechanism, wherein the two lateral pad elements are pivotally connected to the hinge mechanism around two first respective pivots, being mainly parallel to each other, further comprising a connecting part configured to connect the pad device to a force application member of a CPR apparatus or to a gripping part, wherein the at least two pad elements are pivotally mounted to the connecting part around a second pivot of the pad device further comprising:

an automated force application member or a gripping part coupled to the pad device, wherein the automated force application member or the gripping part is configured to transmit force to the pad device.

11. A pad device for the transfer of force to an anterior chest wall of a patient during cardiopulmonary resuscitation (CPR), comprising:

at least two pad elements adapted to be positioned on an anterior chest wall surface, wherein the at least two pad elements comprise two lateral pad elements and a central pad element linking the two lateral pad elements together at respective inner ends of the two lateral pad elements;

a hinge mechanism coupled to the two lateral pad elements of the two pad elements; and a connecting part configured to connect the pad device to a force application member of a CPR apparatus or to a gripping part, wherein (i) the two lateral pad elements of the at least two pad elements are pivotally mounted to respective first and second members of the hinge mechanism around two first respective pivots being mainly parallel to each other, (ii) the at least two pad elements are further pivotally mounted, via the hinge mechanism, to the connecting part around a second pivot of the device, and (iii) the at least two pads elements are still further pivotally mounted, via the hinge mechanism, to the connecting part around a third pivot of the pad device in addition to the second pivot, such that the hinge mechanism cooperatively responds to a force applied when the patient is receiving a CPR.

12. The pad device according to claim 11, wherein the two first respective pivots are mainly parallel to a longitudinal direction of the patient's chest, the second pivot is mainly parallel to a transversal direction of the patient's chest and the third pivot is mainly parallel to a longitudinal direction of the patient's chest, in response to the pad device being placed in an operative position on the patients chest.

13. The pad device according to claim 11, wherein the central pad element includes a pair of elongated slots, each elongated slot being connected by a pin to respective holes at the inner ends of the two lateral pad elements.

14. The pad device according to claim 11, wherein the at least two pad elements each comprise an antifriction contact part designed to contact the patient's anterior chest wall surface.

15. The pad device according to claim 14, further wherein a visco-elastic material layer is disposed between each pad element of the at least two pad elements and a respective antifriction contact part.

16. The pad device according to claim 11,wherein the at least two pad elements are curved to adapt to a body, further wherein the at least two pad elements comprise at least one of a lateral curvature to allow adaptation to a female breast and a caudal curvature to avoid force application on a xyphoid process, the pad device further being mainly symmetrical in a cranial caudal direction.

* * * * *